US005491374A

United States Patent [19]

Porembski

[11] Patent Number: 5,491,374

[45] Date of Patent: Feb. 13, 1996

[54] DOUBLE-BASED LOW-PRESSURE DISCHARGE LAMP WITH MISALIGNMENT-TOLERANT BASES

[75] Inventor: Horst Porembski, Munich, Germany

[73] Assignee: Patent-Treuhand-Gesellschaft F. Elektrische Gluehlampen mbH, Munich, Germany

[21] Appl. No.: 229,177

[22] Filed: Apr. 18, 1994

[30] Foreign Application Priority Data

Apr. 20, 1993 [DE] Germany ..... 9305977 U

[51] Int. Cl.[6] ..... H01J 5/48; H01J 1/62; H01J 17/18

[52] U.S. Cl. ..... 313/318.02; 313/493; 313/623; 313/318.12

[58] Field of Search ..... 313/318.02, 318.12, 313/493, 623; 439/611, 612, 619, 239, 698

[56] References Cited

U.S. PATENT DOCUMENTS

| | | | |
|---|---|---|---|
| 4,752,710 | 9/1988 | Devir et al. . | |
| 4,906,891 | 3/1990 | Takagi et al. . | |
| 5,006,757 | 4/1991 | Odagaki | 313/612 |
| 5,142,191 | 8/1992 | Blaisdell et al. . | |
| 5,276,379 | 1/1994 | Haraden | 313/318 |

FOREIGN PATENT DOCUMENTS 0556800 2/1993 European Pat. Off. .

OTHER PUBLICATIONS

Patent Abstracts of Japan, vol. 016, No. 064 (E–1167), 18 Feb., 1992 and JP–A–03 261030 (Toshiba Lighting & Technol Corp.; others 01) 20 Nov., 1991.

*Primary Examiner*—Sandra L. O'Shea
*Assistant Examiner*—John Ning
*Attorney, Agent, or Firm*—Frishauf, Holtz, Goodman, Langer & Chick

[57] ABSTRACT

To ensure contact of axially bent-back current supply leads, extending over plate-like base terminals of an elongated fluorescent lamp, and ensure electrical connection between the bent-over or bent-back portions with socket terminal springs (9*a*, 9*b*), in spite of misalignment of the bases (3) at two opposite ends of the fluorescent lamp, the junctions or corners (1118) between the narrow wall portions (18*a*, 18*b*) and wide side wall portions (11*a*, 11*b*; 12*a*, 12*b*; 13*a*, 13*b*) of the end portion (4) of the base are set back from the position in a theoretical geometric rectangle or parallelogram to form relieved wide side wall portions. The relieved side wall portions extend axially over essentially the entire length of the end portion (4) of the base. The arrangement permits alignment tolerances, that is, limited relatively canted or twisted positioning of the bases, and insertion into aligned sockets, while ensuring reliable electrical connection between the lamp terminals and the socket connection elements (6*a*, 6*b*).

8 Claims, 6 Drawing Sheets

PRIOR ART
FIG. 5
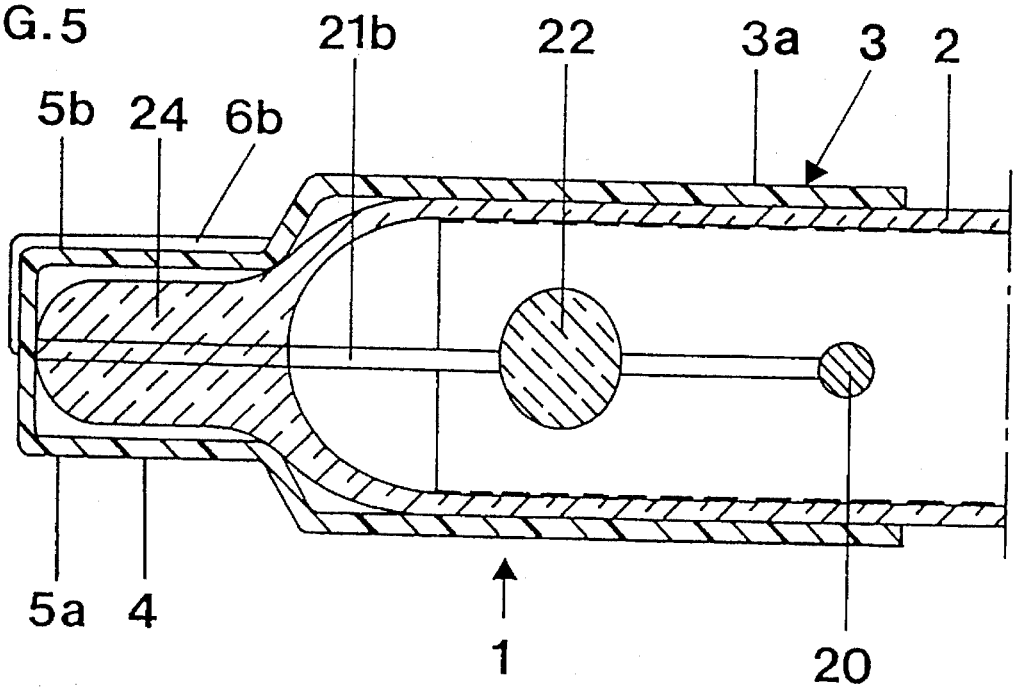
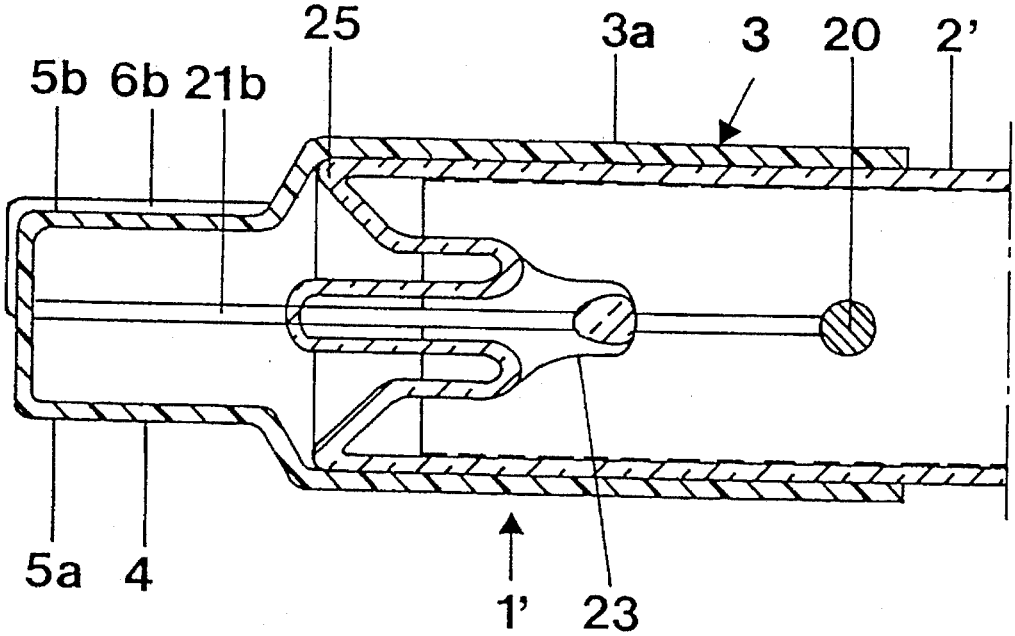
FIG. 6 PRIOR ART

DOUBLE-BASED LOW-PRESSURE DISCHARGE LAMP WITH MISALIGNMENT-TOLERANT BASES

Reference to related patent application and, the disclosure of which is hereby incorporated by reference:

U.S. Ser. No. 07/547,984, filed Jul. 3, 1990, now U.S. Pat. No. 5,142,191, Blaisdell et al.

U.S. Pat. No. 4,906,891, Takagi et al.

Reference to related publication:

European Published Application 0 292 945 A2, Takagi et al.

FIELD OF THE INVENTION

The present invention relates to a double-based low-pressure discharge lamp having a base at each end, in which the base has electrode wires adapted to be placed into suitable sockets, and in which the bases at the two ends of the lamps, for reliable contact with socket terminals, should have a predetermined relative alignment.

BACKGROUND

The referenced U.S. Pat. No. 5,142,191, Blaisdell et al., describes a icy-pressure discharge lamp and, specifically, a subminiature fluorescent lamp which has end terminals formed by press seals for accurate alignment of the lamp relative to an optical system.

The discharge vessel of the low-pressure discharge lamp, hereinafter, for short and generically, a fluorescent lamp, is hermetically closed off at both ends. This hermetic seal can take on two forms, namely either a pinch or press seal or a flare mount, sealed to the ends of the tubular discharge vessel. Two current supply leads at both ends of the tubular discharge vessel are placed in the plane of the pinch or press seal or, respectively, the press portions of the flare mounts, and are carried beyond these seals, outwardly thereof. The leads are melt-sealed to be gas-tight.

Bases which have sleeve portions can be placed over the ends of the tubular discharge vessel for engagement in suitable sockets. The base sleeves are identical at both ends of the discharge vessel and, at a free end, have an essentially plate-like portion, projecting from the sleeve portion of the bases and set on edge, to form, in cross section, approximately a rectangle. This free end portion, which can be snapped between spring terminals in the socket, has oppositely located plane side walls, extending essentially parallel to the plane of the pinch or press seal, or the press portion of the flare mount. The plate-like portions are perforated, that is, formed with openings extending from the facing end, to receive the terminal leads from the electrode connections of the lamp. These terminal leads are bent over the face of the plate element in opposite directions, and then back towards the discharge vessel, parallel to the axis of the lamp. The contact wires, then, will be positioned at respective opposite sides of the plate-like extension, in engagement with the flat or plane side walls thereof.

If the seals at the two ends of the tubular lamp are not in alignment with respect to each other, for example have some twist, or if the bases at the respective ends of the lamp are not placed in exact alignment, the orientation of the plate-like extension of one base will likewise be misaligned with the plate-like extension of the other base. This, then, will also result in relative twist or misalignment of the contact ware pairs at the opposite ends of the discharge vessel, with respect to each other.

The angle of this twist or misalignment depends on the error in aligning the pinch seals or the melt connection of the flare mount in manufacture from perfect alignment. It is very expensive to obtain accuracy in alignment of the seal at the two ends of such a lamp. During mass production manufacture, some tolerance should be permissible. A maximum relative twist angle of about 5° can be maintained with suitable economics of manufacture. As the requirement for accuracy in alignment increases, costs of manufacture also increase.

The sockets for the fluorescent lamps to which the present invention relates customarily use two flat leaf spring terminals, or resilient segments, positioned in the approximate spacing of the two plane side walls of the end plate of the bases of the lamp, and located parallel with respect to each other. Electrical contact between the base and the socket is obtained by direct contact between the contact wires adjacent the planar size surfaces of the base with the leaf spring terminals in the socket.

If the twist angle of the two bases on the lamp with respect to each other exceeds a certain tolerance angle, which depends largely on the diameter of the contact wires, the edges of the base end portion located in the direction of the longitudinal axis of the discharge vessel have the tendency to spread the leaf spring contacts of the sockets outwardly. This interferes with reliable electrical connection and may even interrupt electrical connection between the base and the socket. The shape or form of the narrow walls of the plate-like extension need not be flat; it may be curved, so that no right angles result between the side walls of the end portion of the base and the narrow side walls thereof.

Increasing the diameter of the connecting wire to the electrode to obtain reliable terminals even with a maximum permissible tolerance misalignment angle beyond customary wire diameters is not readily possible because the melt seals to the wires, that is, for example the press seal at the end of the tubular discharge vessel, or the wire seal through a flare mount, may become leaky, leading to destruction of the lamp.

THE INVENTION

It is an object to provide a double-ended, double-based low-pressure discharge lamp which is tolerant to misalignment of the bases at the two ends of the discharge lamp with respect to each other up to a misalignment angle which permits economical manufacture, while still providing reliable electrical connection of the electrode leads when the lamp is placed in a standard socket designed for the lamp, and in which the base construction is simple and inexpensive.

Briefly, the end portion, essentially plate-like, of each of the bases is so shaped that, in cross section, it is of deformed rectangular or parallel shape, and in which the junctions or comers between the narrow wall portions and the wide side wall portions are set back from a theoretical geometric rectangle or parallelogram to form, respectively, relieved narrow wall portions and relieved side wall portions. These relieved portions extend, axially, essentially over the entire length of the end portion of the base.

In cross section, the plate-like end portion of a base in the prior art is a rectangle. In accordance with the present invention, the junctions or corners which extend in the direction of the longitudinal axis of the discharge vessel, and formed by the flat or plane side walls and the essentially perpendicular narrow walls, are replaced by portions which do not have base material, in other words, by relieved portions. By setting back the corners or junctions, which may be rounded, from a theoretical geometric rectangle or parallelogram, which is the cross-sectional shape of the essentially plate-like end portion, a deformed, essentially rectangular or deformed essentially parallelogram shape will result. The leaf spring terminals of a base then can form reliable electrical connections with the connecting lead wires on the bases even if the bases at the end of the tubular vessel are not in perfect alignment.

The requirement of the acceptability of misalignment to be compensated is only a few degrees. If the planes of the wide side wall portions are twisted relative to each other by, for example, about 5°, the misalignment of any one of the bases with respect to the associated socket will be only half, that is, about 2½°. The relevant twist angle which has to be compensated, that is, the twist angle of any one base with the respective socket, is limited since a rotary equilibrium condition will pertain when the double-based fluorescent lamp is placed in a pair of sockets, so that about half of the overall twist angle between the two bases will occur at any one of the base-socket connections.

In accordance with a feature of the invention, the relieved portions are so shaped that, on the one hand, reliable electrical connection between the connecting leads and the socket terminals is ensured while, on the other, the bases can be readily placed into the sockets while maintaining, roughly, the alignment which they should have. Additionally, the wide side walls are so shaped that sufficient engagement surfaces for the connecting lead wires, which are bent thereagainst, will be provided.

The relieved portions can be formed, for example, by flat inclined surface portions, or convex or concave surfaces. If the surface portions are curved, the radius of curvature of the convex, or concave surfaces, respectively, should be selected to be sufficiently large, and the transition between the engagement surface of the respective connection lead to the relieved surface portion should be smooth so that the lamp, with the bases, can be easily fitted into the respective socket without misalignment.

In accordance with a preferred feature of the invention, the relieved portions are so formed that they start immediately adjacent the engagement surface of a terminal contact wire and then extend up to the narrow wall portion remote from the wire, providing sufficient material to form an engagement surface for the electrode terminal wire from which the relieved surface extends.

The arrangement in accordance with the present invention thus ensures contact of the bent-back lead portions of the current supply leads with resilient socket terminals, in which the socket terminals are in pre-aligned positions, while permitting limited respective misalignments of the end portions of the respective bases at the two ends of the discharge vessel, and hence of the current supply leads which extend therefrom and through the end portions of the respective bases.

DRAWINGS

FIG. 1*a* is an end view of a base in accordance with the present invention, fitted on a fluorescent lamp, inserted in a socket, in which the bases at the two ends of the lamp are in alignment so that a twist angle between the planes of the bases at the two ends of the lamp is zero;

FIG. 1*b* is a view similar to FIG. 1*a* in which one base is twisted with respect to another, by a twist angle α;

FIG. 1*c* is a pictorial view of a fluorescent lamp of the prior art and illustrating one base in accordance with the invention;

Figure 4A:
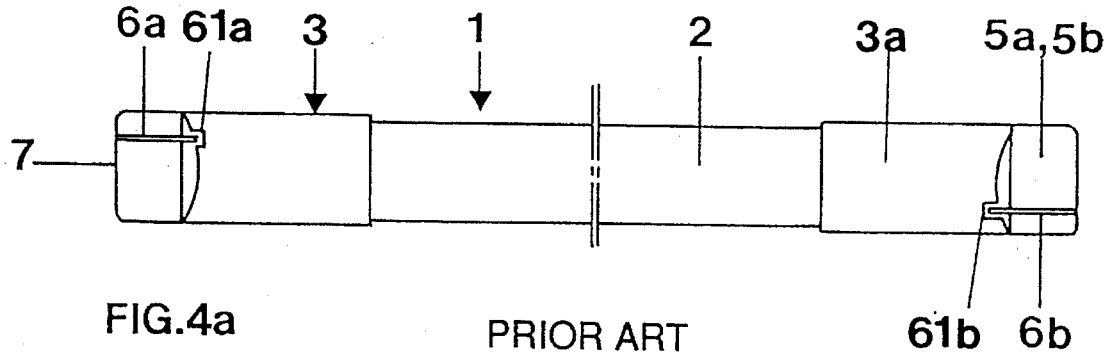
FIG.4a PRIOR ART
Figure 4B:
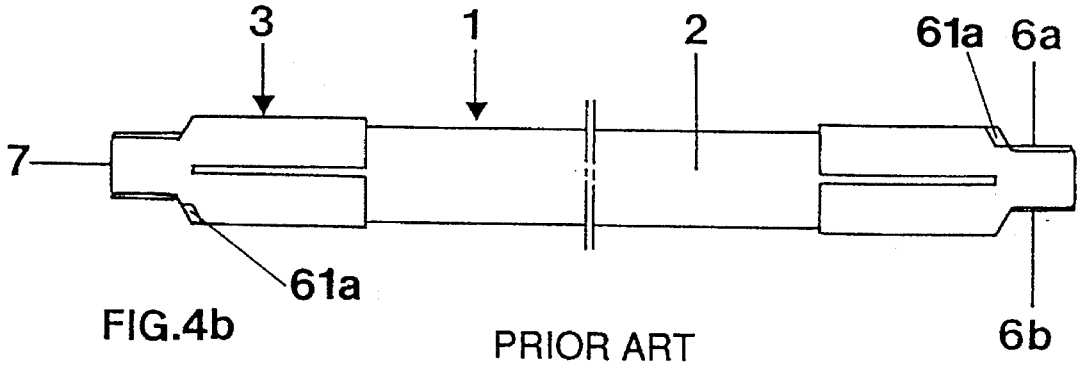
FIG.4b PRIOR ART
Figure 4C:
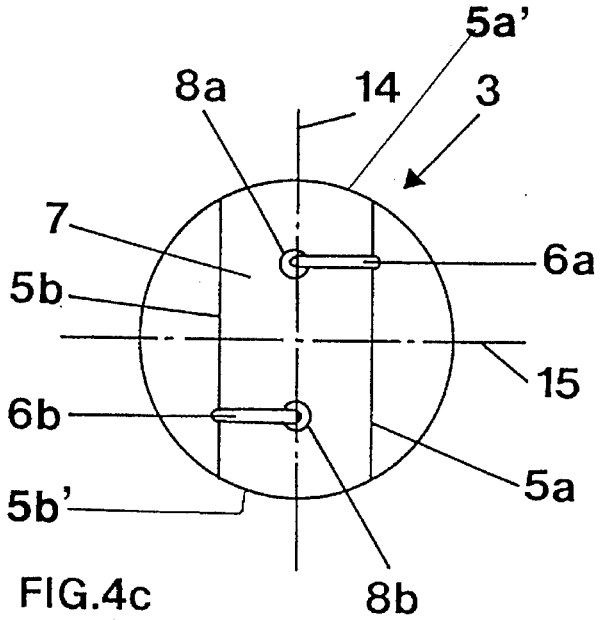
FIG.4c PRIOR ART

FIG. 4*a* is a side view of a double-based fluorescent lamp in accordance with the prior art;

FIG. 4*b* is a top view of the lamp of FIG. 4*a* or, respectively, a view of FIG. 4*a*, rotated 90°;

FIG. 4*c* is an end view of the lamp of FIG. 4*a;*

FIG. 5 is a fragmentary longitudinal section of the end portion of a pinch-sealed fluorescent lamp, fitted in a base, to a scale different to that of FIG. 4*a;*

Figure 1A:
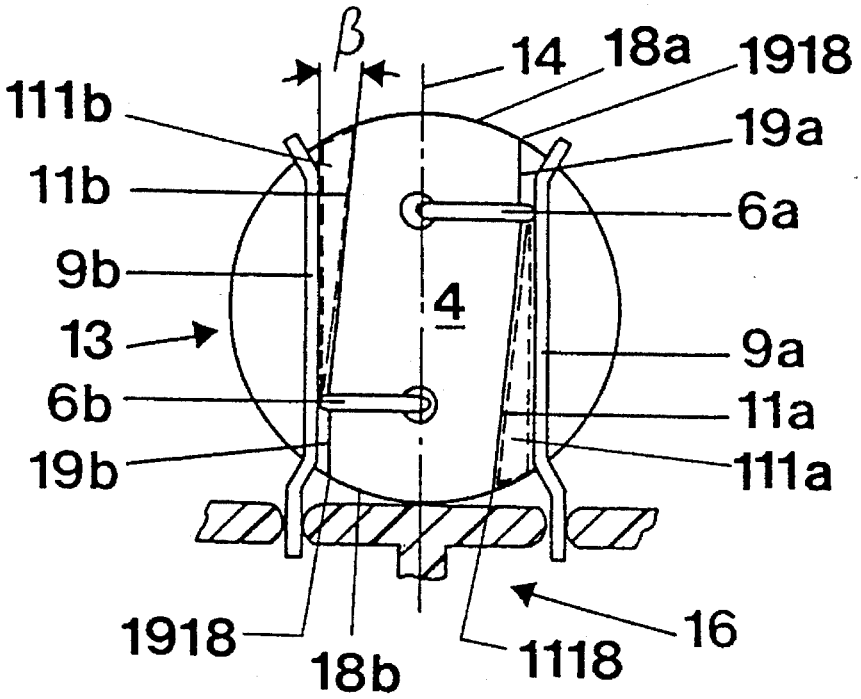
Figure 1B:
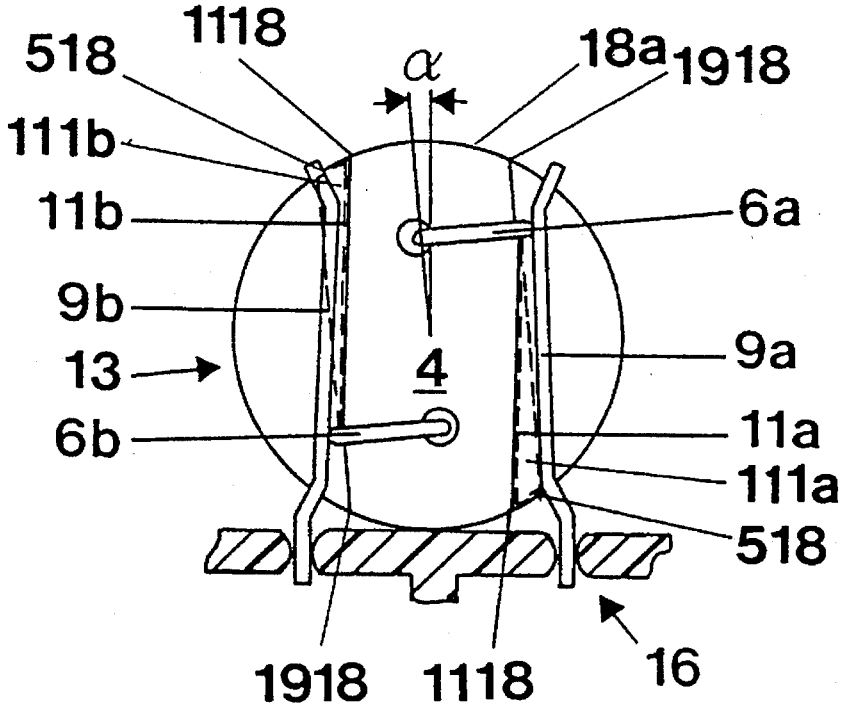
Figure 7A:
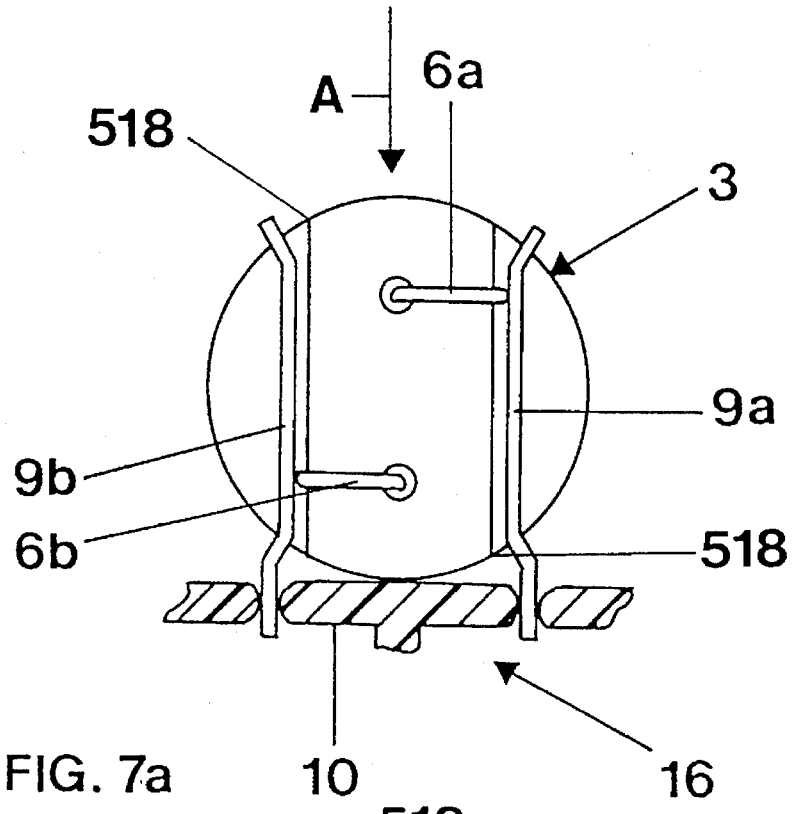
FIG. 7a PRIOR ART
Figure 7B:
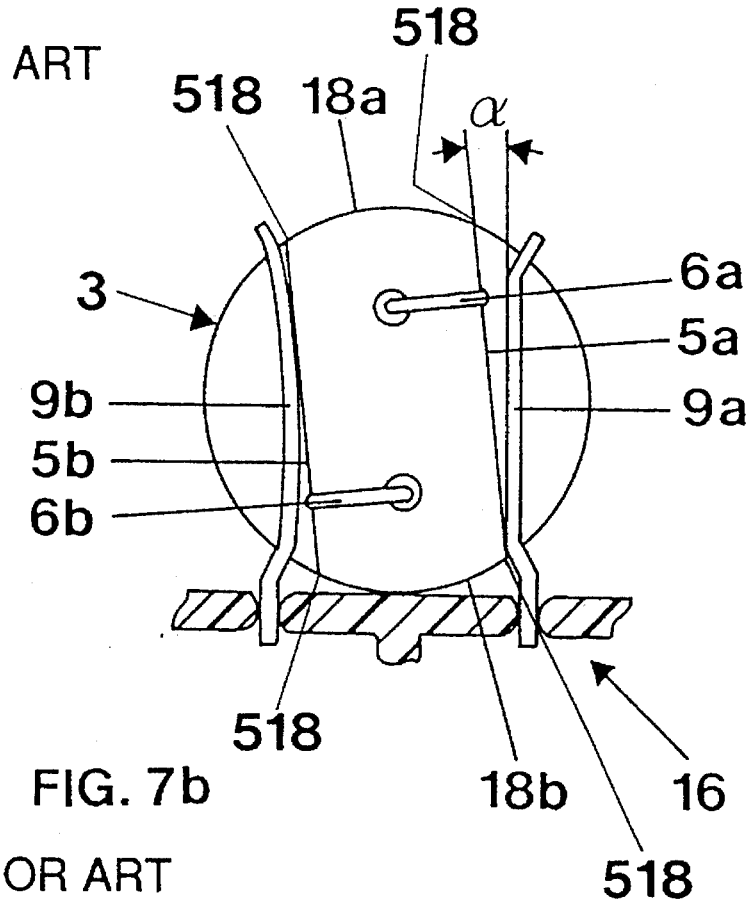
FIG. 7b PRIOR ART

FIG. 6 is a fragmentary longitudinal section of the base end of the lamp having a flare mount sealed to the discharge vessel of the lamp;

FIG. 7*a* is a front view of the base of the lamp of FIG. 4*a*, fitted into a socket, in which the bases at the respective ends of the lamp are in alignment; and FIG. 7*b* is a view similar to FIG. 7*a*, in which the bases the respective ends of the lamp are misaligned by the same angle α of FIG. 1*b*.

DETAILED DESCRIPTION

The construction and arrangement of the base, in accordance with the present invention, will best be understood when its association with a lamp, in the example selected a miniature fluorescent lamp, is first described.

Referring, first, to FIG. 4 (collectively), which shows a double-based miniature low-pressure discharge lamp 1. The discharge vessel 2 is fitted with bases 3 at each end. The base 3 has a first, essentially tubular portion 3*a* forming a sleeve portion of circular cross section (see FIGS. 4*a*, 4*b*, 4*c* and 5), which merges at one end in a flat plate-like end portion. Thus, essentially, the sleeve portion 3*a* initially is circular-tubular at the outside and then merges into the flattened plate-like end portion. This flattened, plate-like end portion is defined by two essentially flat, relatively parallel wide side walls 5*a*, 5*b*, an end face 7 perpendicular to the essentially parallel plane side walls 5*a*, 5*b* and two narrow side walls 5*a'*, 5*b'* which are strip-like continuations of the tubular portion 3*a* and, hence, will have essentially the same curvature as the portion 3*a*. The end face 7, thus, slightly departs from the form of a rectangle, as clearly seen in FIG. 4*c*. In contrast to a rectangle the two narrow wall portions 5*a'*, 5*b'* are not flat, or straight, but slightly curved since they are derived from the curved sleeve portion 3*a*. Thus, the end face 7, or, respectively, the cross section of the flat portion formed by the plane side walls 5*a*, 5*b*, have essentially rectangular shape. The end faces 7 of bases are formed with two through-bores 8*a*, 8*b*, spaced by sufficient distance from each other on the vertical axis 14 the base 3, to ensure electrical insulation and spacing. Current supply leads extending from the lamp pass through the respective bores or openings 8*a*, 8*b* at each base. The current supply leads outside or externally of the base 3 are first bent in opposite directions along the horizontal axis 15 of the base and then, at the two straight edges of the end face 7, are bent backward towards the discharge vessel, parallel to the longitudinal axis of the discharge lamp 1. The current supply leads, thus, provide contact or terminal wires 6a, 6b for insertion in a suitable socket. The contact wires 6a, 6b engage on the plane side walls 5a, 5b of the base. The free ends of wires 6a, 6b engage in recesses 61a, 61b in the sleeve portion 3a of base 3.

FIG. 5 is a longitudinal section of an end portion of a press-sealed lamp 1, illustrating the base 3, with a sleeve portion 3a surrounding the tubular discharge vessel 2 and terminating in the base end 4. The discharge vessel 2 is sealed at its end by a pinch or press seal 24 to be gas-tight. The electrode 20 is electrically connected to two current supply leads, of which only one current supply lead 21b is visible in FIG. 5. The respective current supply lead passes through the pinch or press seal 24, gas-tightly, and then is bent so that it forms the contact wires, of which only the contact wire 6b is visible in FIG. 5. The contact wires, as seen in FIG. 5, are placed against and engage the longer, or wider side wall portions 5a, 5b. The contact wire lying against the side wall portion 5a has been omitted from FIG. 5 for clarity of the drawing. A glass bead 22, extending transversely within the discharge vessel 2, stabilizes the position of the current supply leads within the discharge vessel, and hence the electrode 20.

The actual construction of the discharge vessel does not form part of the present invention, and need not include a pinch or press seal. FIG. 6 illustrates the end portion of a lamp 1' having a discharge vessel 2'. The current supply leads are passed through a flare mount 25, and are sealed in the flare mount by a sealing or pinch or press portion 23. The flare mount 25, itself, is melt-sealed to the end of the tubular discharge vessel 2', as well known The terminal wires, as in the embodiment of FIG. 5, are bent over the end portion 4 and engage the side walls 5a, 5b, respectively, of the end portion 4.

FIG. 7a is a front view of a base 3 in a socket 16 which is in perfect alignment with another, similar base at the other end of the lamp. The base 3 is fitted in the socket 16. The socket 16 has a socket body, shown only in fragmentary representation at 10, and leaf spring terminals 9a, 9b projecting through the body 10. Electrical connection between the lamp, that is, between the base 3 and the socket 16, is obtained by inserting the lamp in the direction of the arrow A, with the end 4 aligned parallel to the springs 9a, 9b into the socket 16, so that the contact wire 6a will engage, and slightly laterally deflect, the contact spring 9a and the contact wire 6b engage against and slightly deflect the socket spring terminal 9b.

FIG. 7b illustrates the situation when the two bases 3 at the end of the discharge lamp are misaligned, so that at least one of the bases will be rotated by a twist angle α when it is placed into the socket 16. The outer edges 518 of the end portion of the base, which are located in the direction of the longitudinal axis of the discharge vessel, and are formed by the junctions or corners of the flat side walls 5a, 5b and the essentially perpendicular narrow walls 18a, 18b of the socket end portion 4, will press the leaf spring terminals 9a, 9b away from each other, and away from the connecting wires 6a, 6b, thereby interrupting electrical connection be=ween the wires 6a, 6b and the leaf spring terminals 9a, 9b. The lamp will not operate.

Figure 1C:
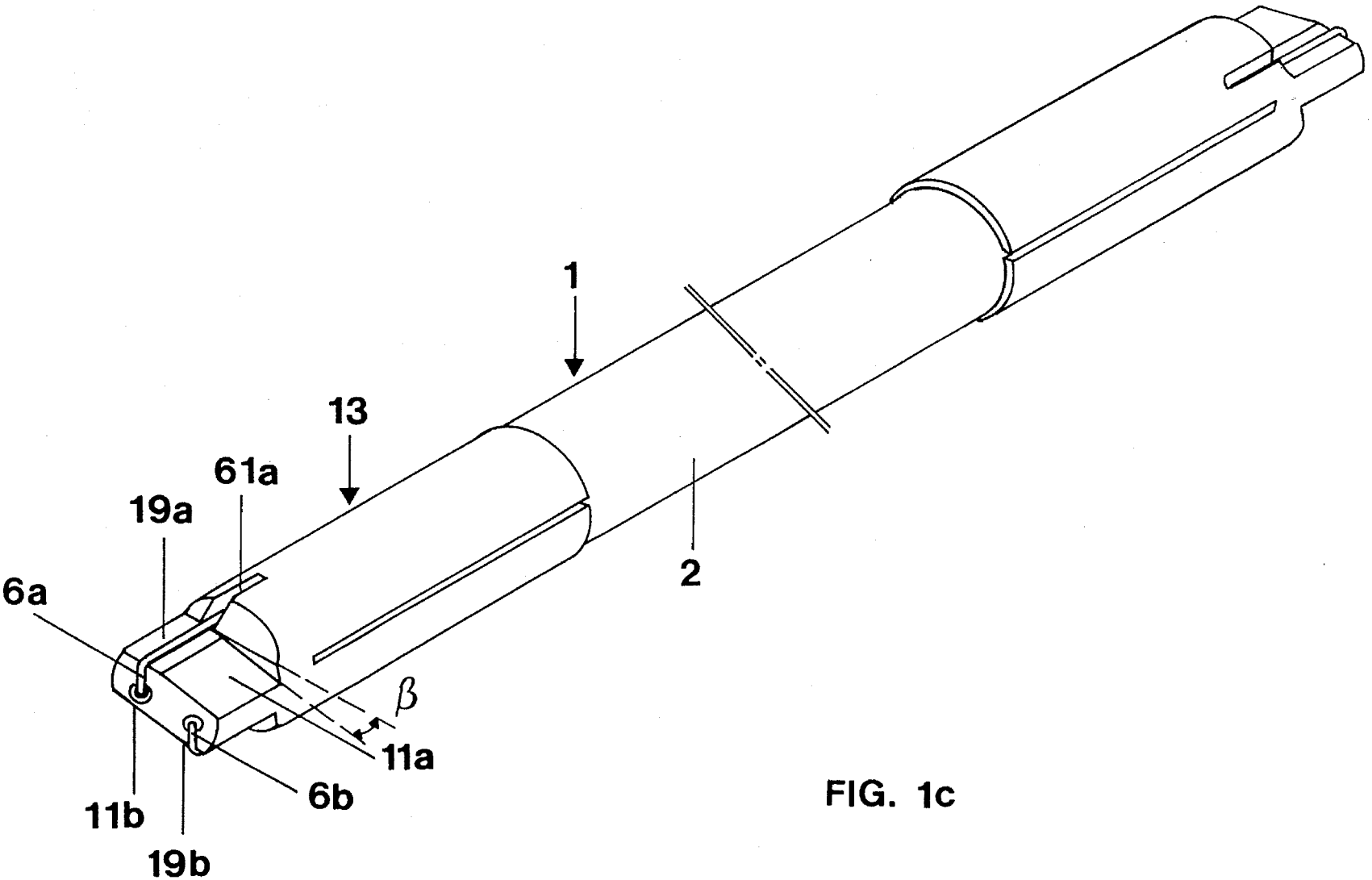

Referring now to FIGS. 1a and FIG. 1c. FIG. 1a illustrates a base 13 in accordance with the present invention, inserted into a socket 16. The leaf spring terminals 9a, 9b face relieved surfaces 11a, 11b of the end portion 4 of the base 13. The relief of the surfaces 11a, 11b with respect to the surfaces 5a, 5b of the prior art, which define theoretical rectangles or parallelograms, starts immediately adjacent the engagement surface of the contact wires 6a, 6b. Still, the plane side walls will form support surfaces 19a, 19b for the contact wires 6a, 6b before the immediately adjacent relieved surfaces 11a, 11b start. The inclined surfaces 11a, 11b, as shown in FIG. 1a, are flat or planar, and extend, axially, essentially over the entire length of the end portion 4 of the base 13. They pass in the vicinity of the second contact wire at an angle β of, preferably, about 5% with respect to a vertical axis 14 of the base 13.

FIG. 1b illustrates the front view of the base 13 in accordance with the present invention, rotated about a twist angle α and fitted in the socket 16. As can be clearly seen, the advantage of the construction in accordance with the present invention is that an electrical contact connection between the socket 16 and the base 13 is ensured, since the leaf springs 9a, 9b can follow, without interference from the base 13, the inclined position of the contact wires 6a, 6b—with respect to a vertical axis of the base. Comparing FIG. 1b with FIG. 7b immediately shows that the relieved surfaces 11a, 11b permit engagement of the terminal or contact leaf springs 9a, 9b with the respective contact wire 6a, 6b and are not pressed away from such engagement by the end portion 4. The respective corners of the relieved surfaces between the end surfaces 18a, 18b of the end portion 4 and the respective surfaces 11a, 11b and 19a, 19b are shown at 1118 and 1918, respectively. This can be clearly seen by comparing the positions of the corners 518 of FIG. 7b with the positions of the corners 1118, 1918 in FIG. 1b.

For ease of visualization of the invention, FIGS. 1a, 1b show, in broken lines the outline of the end portion of the lamp before the relieved surfaces start, namely the portions 111a and 111b. If the end portions shown in broken lines were to extend axially over essentially the entire length of the base 13, the regions 111a, 111b would illustrate the respective end portions of a base of the prior art.

Figure 2:
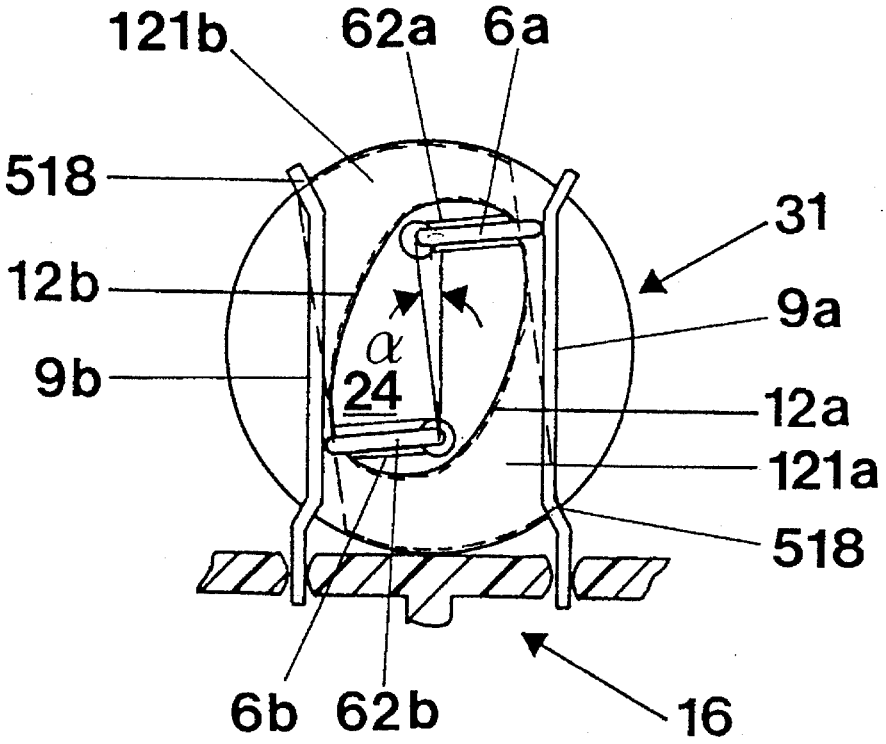
FIG. 2 is a front view of another embodiment of a base in accordance with the invention, fitted in a socket.
Figure 3:
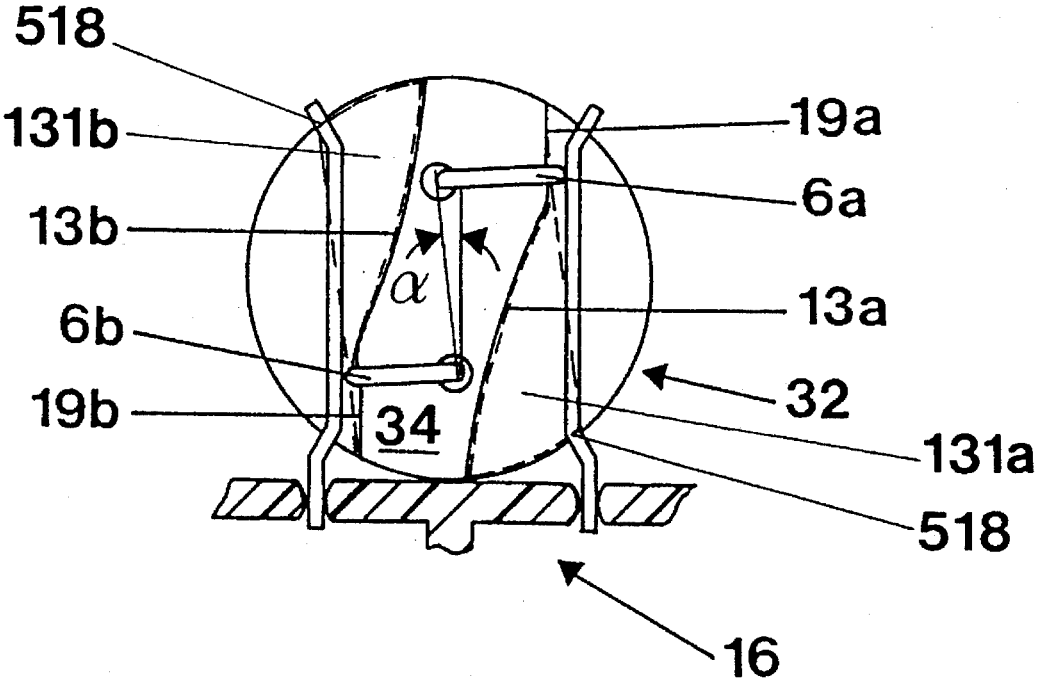
FIG. 3 is a view similar to FIG. 2, illustrating another embodiment of a base.

FIGS. 2 and 3 illustrate other suitable and preferred embodiments of the base 3 in accordance with the present invention, in which, as in FIG. 1b, the base is inserted in the respective socket not in alignment, but twisted by a twist angle.

In accordance with the embodiment of the invention of FIG. 2, the relieved portions of the end 24 of the base 31 will result in convex surfaces 12a, 12b, which are shaped in a generally elliptical form with a large radius of curvature in the longer axis of the ellipse. This construction results in a particularly simple insertion of the base 31 into a socket 16 without interfering with excellent terminal connections. Two grooves 62a and 62b are provided in the front face of the end of the base 31 for guiding the wires 6a and 6b. The grooves 62a, 62b, together with the recesses 61a, 61b, help to fix the position of the wires on the curved side walls of the end of the base 31. Without these grooves the wires might be deflected by the leaf springs 9a, 9b, and the electrical connection would not be reliable.

FIG. 2 also shows the end view of the remaining surfaces of the tubular portion of the base at 121a, 121b or, respectively, the end portion of a prior art base on a lamp. The broken lines outline the surfaces 121a, 121b and clearly illustrate the deformed rectangle, formed by the elliptical surfaces 12a, 12b and the end rounding of the narrower surfaces of the ellipse.

The embodiment in accordance with the present invention illustrated in FIG. 3 is constructed by forming the relieved surfaces of the end portion 34 of the base 3 in concave shape, resulting in concave surfaces 13a, 13b. These surfaces are, in general, similar to a hollow, throated surface. The transition between the concave surfaces 13*a*, 13*b* and the engagement surfaces 19*a*, 19*b* for the connecting wires 6*a*, 6*b* are smooth in order prevent twist of the base 317 upon insertion in the socket 16. For this reason, an embodiment in which the relieved surfaces are formed in steps or with serrations is not recommended.

FIG. 3, again, illustrates in broken lines the outline of the end portion of the base showing surfaces 131*a* and 131*b* which would be the remanent round portions of the base or, respectively, could be the view of the entire base in a prior art lamp.

Considering the difference between the end portions 4 (FIGS. 1*a*, 1*b*) 24 and 34 (FIGS. 2, 3), outlined in solid lines, and with respect to the end portion 7 of FIG. 4*c*, for example, it is apparent that the end portion can be formed as a deformed rectangle, or parallelogram, generically, in contrast to the essentially rectangular surfaces of the prior art. The outlines of these prior art surfaces, for purpose of the present invention, define theoretical geometric rectangles or parallelograms, from which theoretical shapes, in accordance with the present invention, the base portions 4, 24, 34 deviate to permit some misalignment between the respective two end portions of the lamps at their respective ends.

Various changes and modifications may be made, and any features described herein may be used with any others, within the scope of the inventive concept.

I claim:

1. Double based low-pressure discharge lamp (1) having a tubular discharge vessel (2);

electrodes (20) located at respective ends of the discharge vessel;

a glass melt seal (24, 23) at each end of the discharge vessel, each seal defining a press plane;

electrode current supply leads, electrically connected to the respective electrodes and passing through each of the glass melt seals, said electrode current supply leads having portions (6*a*, 6*b*) extending outside of the glass melt seals, the current supply leads at each end of the discharge vessel being located in a plane which is essentially parallel to the axis of the discharge vessel;

two bases (3, 31, 32,), one each being secured to the discharge vessel at the respective end thereof, each base having an essentially sleeve-like cylindrical portion (3*a*) surrounding the discharge vessel (2) and an essentially plate-like end portion (4) which defines two narrow wall portions (18*a*, 18*b*), two side wall portions (5*a*, 5*b*) and an end face (7), said end portion being formed with openings (8*a*, 8*b*) extending axially through the end face (7) and being located essentially in said press plane, said externally extending current supply lead portions (6*a*, 6*b*) extending through said openings, being bent over said end face (7) in respectively opposite directions and then further bent axially with respect to the tubular vessel, and towards the tubular vessel, lying on and fitting against opposite side wall portions (5*a*, 5*b*) of the end portion (4) of the base (3) to define bent-back lead portions, said lamp comprising, in accordance with the invention, an arrangement for ensuring contact of the bent-back lead portions (6*a*, 6*b*) of the current supply leads with socket terminals (9*a*, 9*b*) located in pre-aligned positions, while permitting limited respective misalignment of the end portions (4) of the respective bases (3) at the ends of the discharge vessel, and hence of said bent-back lead portions (6*a*, 6*b*) extending therefrom, wherein, in said arrangement, the end portion (4, 24, 34) of the base (3) has the shape of a deformed rectangle, or deformed parallelogram, in which at least two of the junctions or corners (1118) between the narrow wall (18*a*, 18*b*) and the wide side wall portions (11*a*, 11*b*) are set back from a theoretical geometric rectangle or parallelogram, to form, respectively, relieved wide side wall portions (11*a*, 11*b*; 12*a*, 12*b*; 13*a*, 13*b*), which relieved portions extend axially essentially over the entire length of the end portion (4, 24, 34) of the base.

2. The lamp of claim 1, wherein said relieved side wall portions (11*a*, 11*b*; 12*a*, 12*b*; 13*a*, 13*b*) start adjacent an engagement surface (19*a*, 19*b*) of the bent-back lead portions (6*a*, 6*b*) with the respective side wall of the end portion (4) of the base.

3. The lamp of claim 2, wherein the engagement surfaces of the bent-back portions (6*a*, 6*b*) of the end portions (4) of the bases (3) are essentially flat, and unrelieved with respect to said theoretical geometric rectangle or parallelogram.

4. The lamp of claim 1, wherein said relieved wide side wall portions (18*a*, 18*b*) are formed as essentially flat planar surfaces, and define the angle of inclination $\beta$ of said surface with respect to a theoretical line connecting said axially extending openings (8*a*, 8*b*) of between 0° and about 10°.

5. The lamp of claim 1, wherein the relieved wide side wall portions (12*a*, 12*b*) are formed as convexly shaped curved surfaces (12*a*, 12*b*).

6. The lamp of claim 1, wherein the cross-sectional shape of said end portion (24) is approximately elliptical, said curved surfaces forming the curvature of the ellipse in the direction of the major axis of the ellipse.

7. The lamp of claim 1, wherein the relieved wide side wall portions (13*a*, 13*b*) of said end portions (34) are formed as shallow concave surfaces.

8. The lamp of claim 1, wherein the engagement surfaces of the bent-back portions (6*a*, 6*b*) of the end portions (4, 24, 34) of the bases (3) are essentially flat, and unrelieved with respect to said theoretical geometric rectangle or parallelogram;

and wherein the transition between the relieved surfaces and said engagement surfaces is smooth and rounded.

* * * * *